US011464255B1

(12) United States Patent
Faria

(10) Patent No.: US 11,464,255 B1
(45) Date of Patent: Oct. 11, 2022

(54) RE-USABLE CIGARETTE HOLDER FOR FACILITATING FILTERING, GRIPPING AND ENHANCING SAFETY WHILE SMOKING

(71) Applicant: Kevin C. Faria, Mississauga (CA)

(72) Inventor: Kevin C. Faria, Mississauga (CA)

( * ) Notice: Subject to any disclaimer, the term of this patent is extended or adjusted under 35 U.S.C. 154(b) by 1206 days.

(21) Appl. No.: 15/960,978

(22) Filed: Apr. 24, 2018

(51) Int. Cl.
*A24F 13/06* (2006.01)
*A24F 13/08* (2006.01)
*A24F 7/02* (2006.01)

(52) U.S. Cl.
CPC ..... *A24F 13/06* (2013.01); *A24F 7/02* (2013.01); *A24F 13/08* (2013.01)

(58) Field of Classification Search
CPC ..... A24F 13/02; A24F 13/06; A24F 13/08; A24F 13/00; A24F 13/14; A24F 13/16
USPC ..... 131/174, 175, 187, 190
See application file for complete search history.

(56) References Cited

U.S. PATENT DOCUMENTS 1,522,606 A * 1/1925 Velde ..... A24F 13/02 131/188
1,799,550 A * 4/1931 Farris ..... A24F 13/10 131/182
3,237,629 A * 3/1966 Sauer ..... A24F 13/14 131/181
4,250,901 A * 2/1981 Yamaguchi ..... A24F 13/06 131/202
6,182,669 B1 * 2/2001 van der Elst ..... A24D 1/12 131/187
2006/0266374 A1 11/2006 Nyborg et al.

FOREIGN PATENT DOCUMENTS

CN 107156908 9/2017

* cited by examiner

*Primary Examiner* — Dionne W. Mayes
(74) *Attorney, Agent, or Firm* — Sanchelima & Associates, P.A.; Christian Sanchelima; Jesus Sanchelima

(57) ABSTRACT

The present invention is a cigarette holder for holding cigarette while smoking. Cigarette holder is formed of mouthpiece, a filter casing with at least one filter, a user holder and a cigarette cage for easily inserting and removing cigarette. User holder is encircled around cigarette cage and hence prevents accidental touch of flamed cigarette. User holder is provided with a gripping material which facilitates user's to firmly grip cigarette holder with less pressure and firm gripping prevents slippage or accidental touch of flamed portion of cigarette. Also, gripping allows passing cigarette holder with cigarette from one user/smoker to another and hence can be passed to multiple hands without any risk of fall. During inhaling, smoke is passed through filter that filters out debris from the smoke and thus prevents debris for being consumed. Also, after use, cigarette holder can be cleaned and thus can be re-used.

7 Claims, 4 Drawing Sheets

SECTIONAL A-A

SECTIONAL B-B

SECTIONAL C-C

RE-USABLE CIGARETTE HOLDER FOR FACILITATING FILTERING, GRIPPING AND ENHANCING SAFETY WHILE SMOKING

BACKGROUND OF THE INVENTION

1. Field of the Invention

The present disclosure relates to a holder for holding a cigarette. More particularly, the present disclosure relates to a re-usable cigarette holder for facilitating filtering, gripping, less holding pressure and safety while smoking.

2. Description of the Related Art

While smoking, flammable side of a cigarette can accidently touch smoker or any person, receiving cigarette from smoker, for smoking and burn the skin. Smoker also need to continuously hold cigarette with pressure between index and middle finger which is tiresome. Also, while passing/handling cigarette from one smoker to another, it is likely that cigarette may fall owing to smooth outer surface of cigarette which do not provide adequate grip. In event of smoking, debris are formed that can touch user's/smoker's lips or can accidentally consume debris formed which are undesirable.

Several designs of various cigarette holders have been designed in the past. None of them, however, include a re-usable cigarette holder that facilitates filtering, firm gripping, holding with less pressure and provides safety.

Applicant believes that a related reference corresponds to China patent 107156908 filed by Cong Chunhua, Inc. titled 'Thick and thin cigarette universal filter cigarette holder' disclose a cigarette holder that has a filter to filter out toxics. Although, the disclosure relates to filtering out of toxics, however, the disclosure is silent on safety and gripping aspects while handling by a smoker and also while passing cigarette from on smoker to another.

Another related reference is US patent application 20060266374 filed by Nyborg, Armand A. and Cox, William C. titled 'Finger attached cigarette holder discloses a cigarette holder that has a finger ring for attaching to a person's finger and a cigarette ring sized to hold a cigarette therein. Although, the present disclosure mentions about cigarette holder that may prevent accidental falling of cigarette, however, such cigarette holder may not be useful while handing over cigarette from one smoker to another. Also, in flamed condition, there is no provision to protect smoker or surrounding person from accidental touch of the flame.

Other documents describing the closest subject matter provide for a number of more or less complicated features that fail to solve the problem in an efficient and economical way. None of these patents suggest the novel features of the present invention.

SUMMARY OF THE INVENTION

In view of the above, it is an objective of the present invention to solve or at least reduce the problems discussed above. The present invention is a cigarette holder for holding cigarette while smoking. Cigarette holder is formed of mouthpiece, a filter casing with at least one filter, a user holder and a cigarette cage. Cigarette is inserted and caged in cigarette cage disposed in user holder for and then lit. User can then hold user holder which is provided with gripping material which facilitates firm gripping of cigarette holder with less pressure and firm gripping prevents slippage or accidental touch of flamed portion of cigarette. Also, gripping allows passing cigarette holder with cigarette from one user/smoker to another and hence can be passed to multiple hands without any risk of fall. User can then insert mouthpiece in mouth and inhale to enjoy smoke. During inhaling, smoke is passed through filter that filters out debris from the smoke and thus prevents debris for being consumed. Also, after use, cigarette holder can be cleaned and thus can be re-used.

It is one of the main objects of the present invention is to provide a cigarette holder that is provided with adequate gripping when hold by a smoker or by passing from one smoker to another.

It is another object of this invention is to provide a cigarette holder that provides adequate safety in flammable condition to user or surrounding persons (smoker or non-smoker).

It is another object of this invention is to provide a cigarette holder that filters debris from being consumed by user/smoker.

It is another object of this invention is to provide a cigarette holder that can be easily held without pressure by a smoker utilizing any fingers of the hand.

It is another object of this invention is to provide a cigarette holder that can be cleaned after desired usage and is therefore re-usable.

It is another object of this invention is to provide a cigarette holder that is compact and hence portable.

It is another object of this invention is to provide a cigarette holder that is user-friendly.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
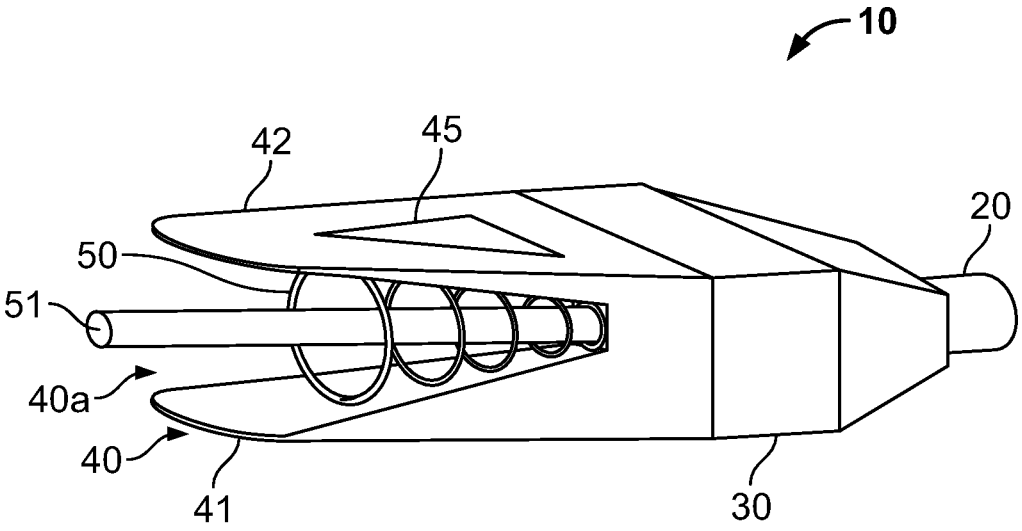
FIG. 1 represents a perspective view of a cigarette holder holding a cigarette, in accordance with one embodiment of the present invention.
Figure 2:
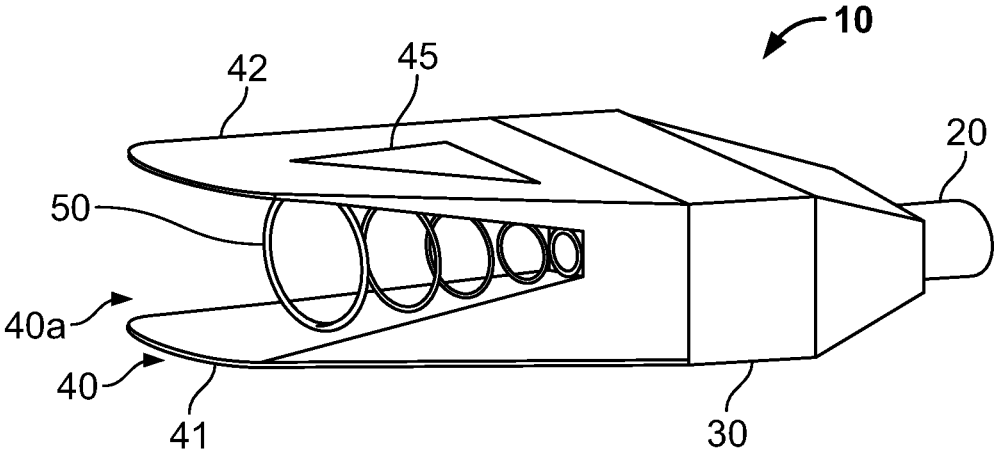
FIG. 2 represents another perspective view of the cigarette holder of FIG. 1 without a cigarette.
Figure 3:
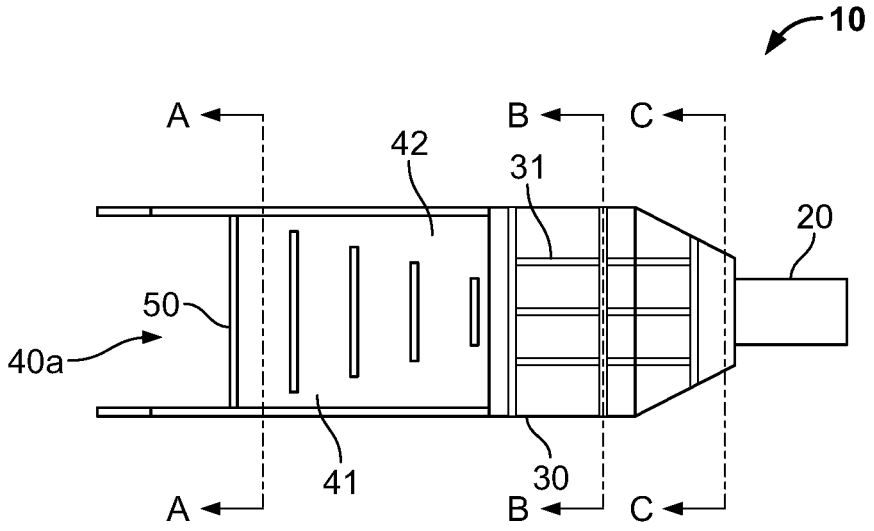
FIG. 3 represents a front view of the cigarette holder of FIG. 2.
Figure 4:
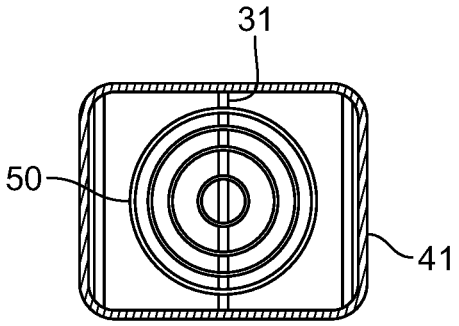
FIG. 4 is a section view of the section A-A represented in FIG. 3.
Figure 5:
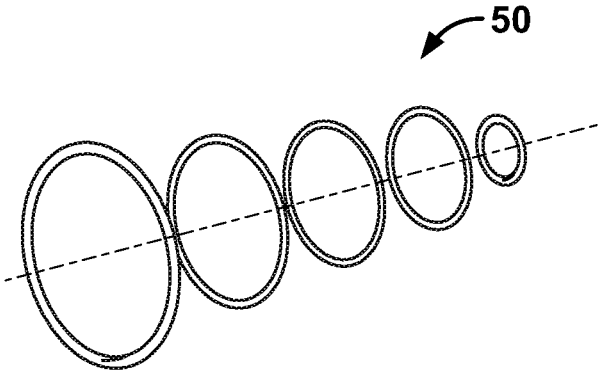
FIG. 5 represents a perspective view of cigarette cage formed by number of concentric rings.
Figure 6:
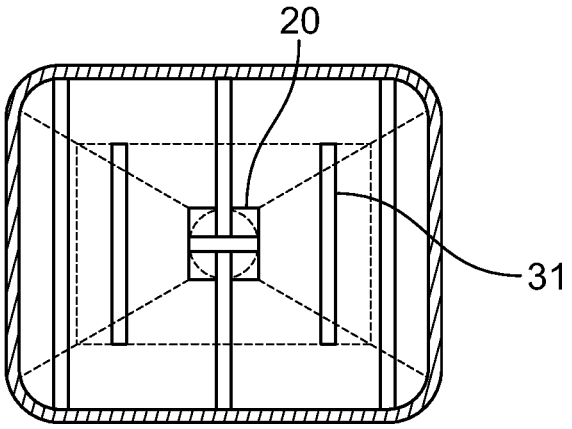
FIG. 6 is a section view of the section B-B represented in FIG. 3.
Figure 7:
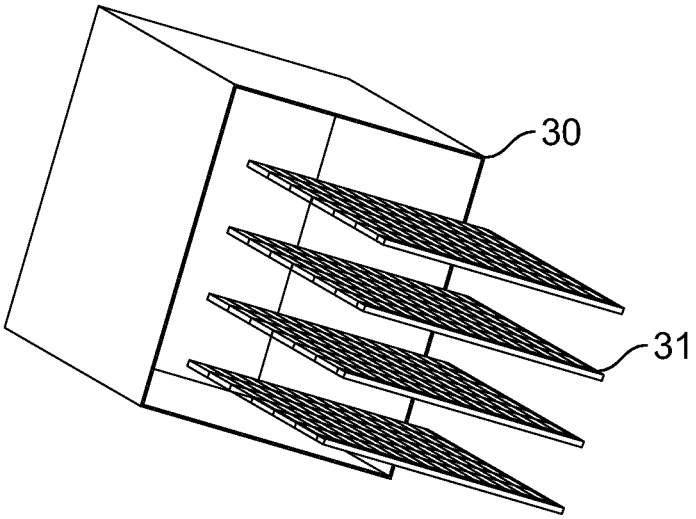
FIG. 7 is an exemplary perspective view of filter casing with number of filter layers of the cigarette holder of FIG. 1.
Figure 8:
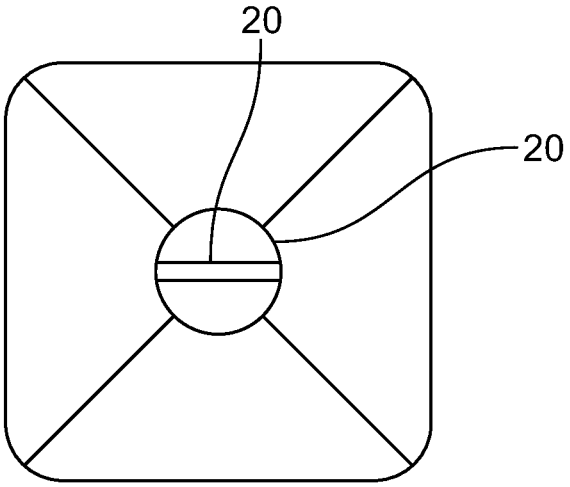
FIG. 8 is a section view of the section C-C represented in FIG. 3.

Referring now to the drawings (FIGS. 1 to 9), where the present invention is generally referred to with numeral 10, it can be observed that a re-usable cigarette holder for holding medicinal or recreational cigarette/joint like marijuana, in accordance with one embodiment, is provided that includes a mouthpiece 20, a filter casing 30 with at least one filter 31, a user holder 40 and a cigarette cage 50. At least two or more of the components like mouthpiece 20, filter casing 30 and user holder 40 can be integral parts or each can be a separate unit.

Mouthpiece 20 is provided to be inserted in user's/smoker's mouth while smoking. Shape of mouthpiece 20 can be circular, square or any other ergonomic shapes. Size of mouthpiece 20 can also be selected/varied as per user's need.

Filter casing 30 is provided adjacent to mouthpiece 20. Filter casing 30 has one or more layers of filters 31. Filters 31 are barriers or dividers that can be arranged horizontally or vertically, or can be arranged horizontally and vertically in desired sequence and manner. Filters 31 can filter toxics, smoke and debris formed due to the burning of cigarette from entering a smoker's mouth.

Figure 9:
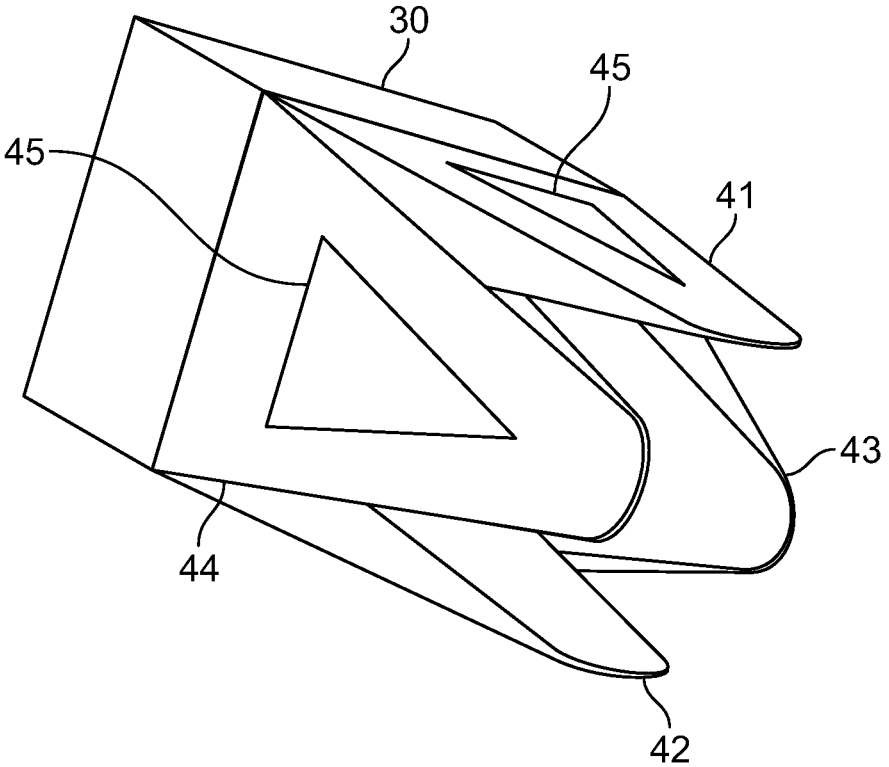
FIG. 9 is a perspective view of the user holder having four gripping portions in accordance with another embodiment of the present disclosure.

User holder 40 is provided adjacent to filter casing 30. User holder 40 has a central cavity 40*a* that accommodates cigarette cage 50. User holder 40 encircles cigarette and hence prevents user/smoker or surrounding personnel from getting in touch with the flamed portion of cigarette and hence provides safety. Along with touch in any part of the body of smoker or surrounding personnel, smoker's hand and mouth are protected from flamed portion. User holder 40 also has an opening from at least one side to receive cigarette 51 or like smoking sticks which will be secured by cigarette cage 50. User holder 40 can be a continuous structure or can be strapped structure having two or more straps. For instance, FIGS. 1 to 8 shows user holder 40 with one continuous structure being circular shape and FIG. 9 shows user holder 40 with four straps 41, 42, 43 and 44. Continuous structure apart from being circular shaped can be tapered shaped, elliptical shaped, oval shaped, trapezoidal shaped or can be like any other shapes or combination of shapes. Straps can also vary in numbers as per requirement. At least a portion of the outer surface of user holder 40 is provided with a grip material like polymeric material that can provide grip to user or can be other material with a criss-cross/line patterns configured thereon like knurling. For example, when user holder 40 is provided with continuous structure or straps 41, 42 and/or 43, 44, at least an outer portion of continuous structure or straps 41, 42 and/or 43, 44 is provided with a grip material 45. Grip material 45 provides sufficient grip to hold the entire cigarette holder 10. Moreover, grip material 45 helps user to hold cigarette holder 10 with ease with any fingers and without limitation to conventionally used index finger and middle finger without exerting pressure therebetween. Also, the grip material 45 facilitates easy handling/passing/transferring cigarette holder 10 from one person to another and hence prevents conventional accidental fall of cigarette 51 owing to smooth outer surface of cigarette 51.

Cigarette cage 50, in one embodiment, is a number of concentric rings. Concentric rings are arranged in ascending order such that smallest ring is near filter casing 30. Such concentric rings help efficient holding of cigarette, typically, variable size of cigarettes. Typically, five concentric rings can be used, however, depending upon need more or less number of concentric rings can be used that can firmly hold cigarettes of one or different size(s).

The material that can be used for user holder 40 and/or cigarette cage 50 can be stainless steel and heat-resistant plastic. The size of a typically cigarette holder 10 measures approximately 1½ inches long and ¾ inches wide. However, size of cigarette holder 10 can be varied as per need. Shape, color and pattern of cigarette holder 10 can be varied/altered depending upon the need.

In operation, user/smoker is required to insert cigarette 51 in cigarette cage 50 that firmly holds cigarette 51 therewithin. User/smoker can then hold user holder 40 in hand, typically by thumb and forefinger. Once held properly, user/smoker can light cigarette 51. User can then draw smoke by inserting mouthpiece 20 in mouth followed by inhaling. During inhaling, smoke is passed through filter 31 for filtering smoke so that debris formed is filtered from entering user's/smoker's mouth or coining in contact with lips thus will enhance safety and comfort. Grip material 45 of user holder 40 helps to hold cigarette holder 10 without excessive pressure and provide comfort to user/smoker. Also, user holder 40 protects finger and mouth and prevents burning of fingers or mouth and provides safety.

When user/smoker want to share cigarette with other user(s)/smoker(s), then user/smoker can hand over cigarette holder 10 with cigarette 15 while lit. As grip material 45 is provided on user holder 40 of cigarette holder 10, gripping of cigarette holder 10 is more firm and hence there are less chances of falling of cigarette holder 10 with flamed cigarette 51 and hence prevents occurrence of undesired accidents. Also, user holder 40 ensures that flamed portion of cigarette 51 does not touch a user's fingers.

Once cigarette 51 is fully consumed, user can remove consumed cigarette 51 and discard it. Cigarette holder 10 can then be opened and completely washed for re-use. Washing can be with soap and water or simply water depending upon user's wish.

Cigarette holder 10 is thus easy to use, convenient, practical, time and effort saving, safety enhancing, light weight, compact, portable, affordable, and durable for years of effective use.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A smoking device, comprising:

a housing, having a distal end and a proximal end, said housing further including: a hollow filter casing of substantially rectangular cross-section, having at least two filters enclosed by said filter casing, a user holder, provided adjacent to said filter casing, having an open mouth configuration at said distal end, said open mouth configuration including a top portion, a bottom portion, a right lateral portion, and a left lateral portion, each portion having rounded distal free ends, and tapered proximal connected ends that meet at said filter casing, and a smoking article cage defined by a plurality of concentric rings of varying diameter size, each ring enclosed by said top, bottom, right lateral and left lateral portions, said rings being arranged in ascending order based on diameter size with the smallest diameter ring being adjacent the filter casing, and said rings being configured to efficiently hold smoking articles of variable size;

a mouthpiece, mounted on the proximal end of said housing, for insertion into the mouth of a user;

a smoking article inserted into said smoking article cage; and an opening within said housing extending from said distal end to said mouthpiece and adapted to deliver smoke through said mouthpiece and into user's mouth;

wherein, a grip material layer is mounted to an outer surface of said user holder, and said mouthpiece is arranged about a longitudinal axis, and said at least two filters are arranged on a plane that is orthogonal to said longitudinal axis.

2. The smoking device of claim 1 wherein said mouthpiece is interchangeable.

3. The smoking device of claim 1 wherein said smoking article includes a central cavity wherein said smoking article is inserted.

4. The smoking device of claim 1 wherein said smoking article is inserted through all of said plurality of rings.

5. The smoking device of claim 1 wherein said housing is adapted to provide the user with a location to grab thereon and maintain a burning end of the smoking article from a user's hand.

6. The smoking device of claim 1 wherein said bottom portion and said filter casing is an integral and continuous member.

7. The smoking device of claim 1 wherein a grip material layer is mounted to said top portion.

* * * * *